US007297030B2

(12) United States Patent
Chang

(10) Patent No.: US 7,297,030 B2
(45) Date of Patent: Nov. 20, 2007

(54) TELECOMMUNICATION CABLE ADAPTER

(76) Inventor: Hsi-Fan Chang, 8F-6, No. 18, Lane 609, Sec., 5, Chung Shin Road, Sanchung, Taipei (TW)

( * ) Notice: Subject to any disclaimer, the term of this patent is extended or adjusted under 35 U.S.C. 154(b) by 0 days.

(21) Appl. No.: 11/419,526

(22) Filed: May 22, 2006

(65) Prior Publication Data

US 2007/0093087 A1 Apr. 26, 2007

(51) Int. Cl.
*H01R 24/00* (2006.01)

(52) U.S. Cl. ..... 439/676; 439/638; 439/571

(58) Field of Classification Search ..... 439/676, 439/638, 527, 571–572
See application file for complete search history.

(56) References Cited

U.S. PATENT DOCUMENTS 4,188,505 A * 2/1980 O'Connor ..... 439/676

* cited by examiner

*Primary Examiner*—Javaid H. Nasri
(74) *Attorney, Agent, or Firm*—Banger Shia

(57) ABSTRACT

A communication adapter for wall-mounting panel to provide better fastness, easy structure, lower production costs and powerful utility includes a casing comprised of an upper lid and a lower lid, a circuit board in the casing, plug and socket connecting to the circuit board, and locking hole on the lower lid to secure the upper lid to the lower lid with a locking pin; a locking tongue being disposed to the lower lid and a hole on the upper lid to allow pulling the locking tongue.

5 Claims, 4 Drawing Sheets

TELECOMMUNICATION CABLE ADAPTER

BACKGROUND OF THE INVENTION (a) Field of the Invention

The present invention is related to a communication adapter, and more particularly, to one that can be secured to a wall-mounting panel.

(b) Description of the Prior Art

Computer and telephone have been comprehensively applied in home and office thanks to ever-advancing electronic technology in recent years. Therefore, communication adapters generally available in the market give two interfacial functions; wherein, communication signals delivered through communication cable are respectively transmitted into the computer and telephone after passing their corresponding interfaces at the part of filtration. Whereas some subscribers tend to have their telephone sets on the wall, a wall-mounting communication panel as illustrated in FIG. 1 of the accompanying drawings is provided. To improve its fastness to the wall, the panel is disposed with soft rubber pad on the side against the wall. However, the application of gel involves higher cost and poor fastness.

SUMMARY OF THE INVENTION

The primary purpose of the present invention is to provide an improved communication adapter in simple structure, lower production cost, and strong utility to correct the flaws found with the prior art To achieve the purpose, the present invention includes a casing comprised of an upper lid and a lower lid, a circuit board contained in the casing, plug and socket connecting to the circuit board, and a locking hole to secure a locking pin is disposed on the lower lid. One or a plurality of locking tongue is disposed on the lower lid to further secure the locking pin into the locking hole, and a hole to pull the locking tongue is disposed on the upper lid to facilitate assembly or disassembly process of the communication adapter.

Two or multiple sockets are disposed on the surface of the casing, and two sockets, one for telephone communication and another for computer, are generally provided. The locking tongue is comprised of a pull part, a locking part to secure the locking pin, and a curved part connecting to the lower lid. The displacement of the locking pin is restricted on the locking pin is inserted into the locking hole to achieve the purpose of fastness. To disassembly, the pull part is activated to drive the locking part to create a certain elastic displacement so to easily remove the locking pin from the locking hole. The locking tongue and the lower lid are made in an integrated part of plastic or hardware given with certain elasticity. Two or multiple locking holes are disposed on the lower lid to be secured to a wall-mounting unit.

DETAILED DESCRIPTION OF THE PREFERRED EMBODIMENTS

Figure 1:
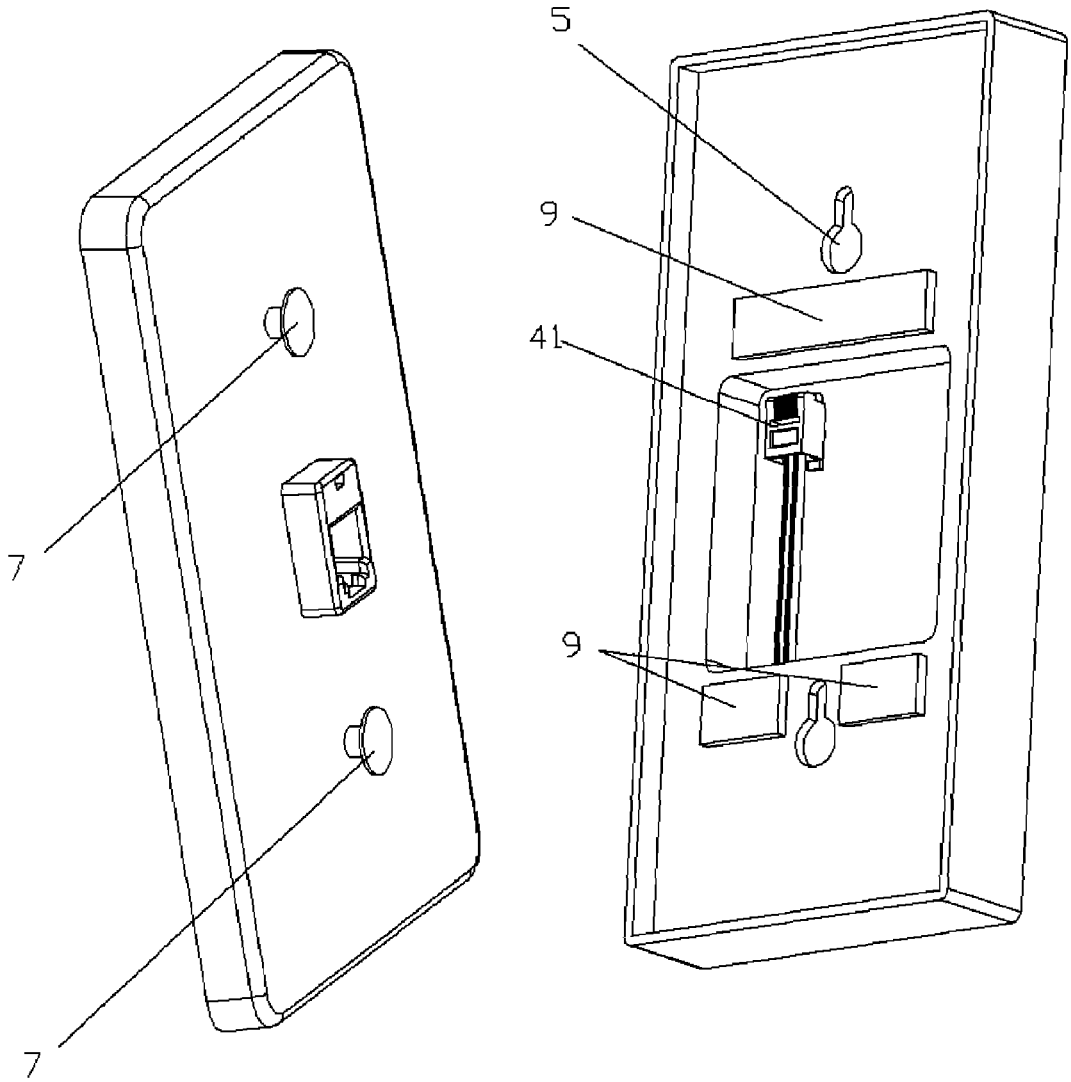
FIG. 1 Prior Art
FIG. 1 is a schematic view showing a construction of a communication adapter of the prior art.

Referring to FIG. 1 for a communication adapter of the prior art. Wherein, two pieces of soft rubber 9 are stick to the back of the communication adapter. Once both locking pins 7 are pushed into their respectively holes 5, the elastic return force of the soft rubber 9 will secure both of the adapter and the locking pins 7 in place to hold firm the adapter to the wall. However, when the adapter is subject to a relatively greater upward force, the inherited property of the soft rubber 9 may disengage it from the locking pins 7. Furthermore, the fastness of the adapter will be compromised by fatigue of the elasticity of the soft rubber 9 after a longer time of use.

Figure 2:
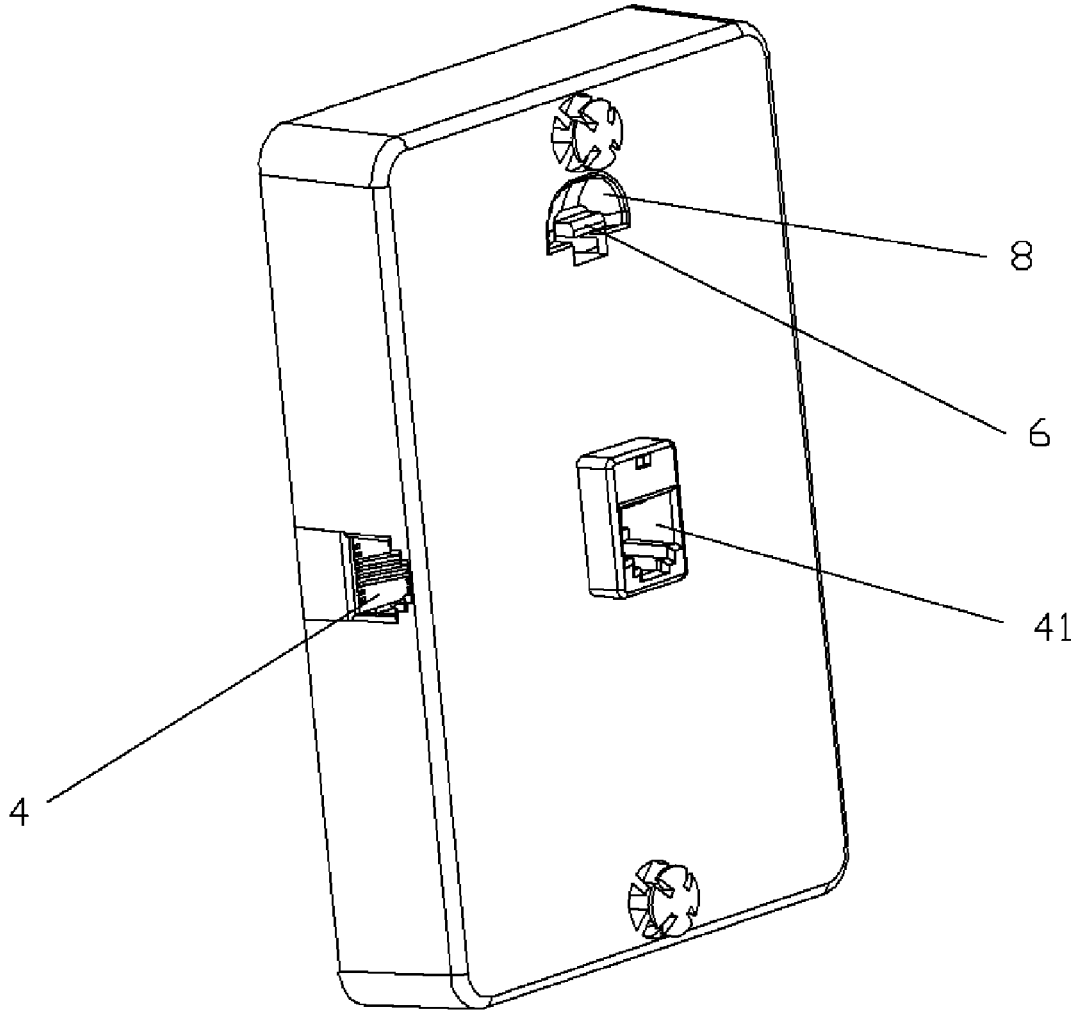
FIG. 2 is a perspective view showing a construction of the present invention.

As illustrated in FIG. 2, two sockets 4 are provided to a preferred embodiment of the present invention, a hole 8 to pull a locking tongue 6 is disposed to an upper lid 1 to allow the user to pull a locking tongue 6 for easy disassembly of the adapter.

Figure 3:
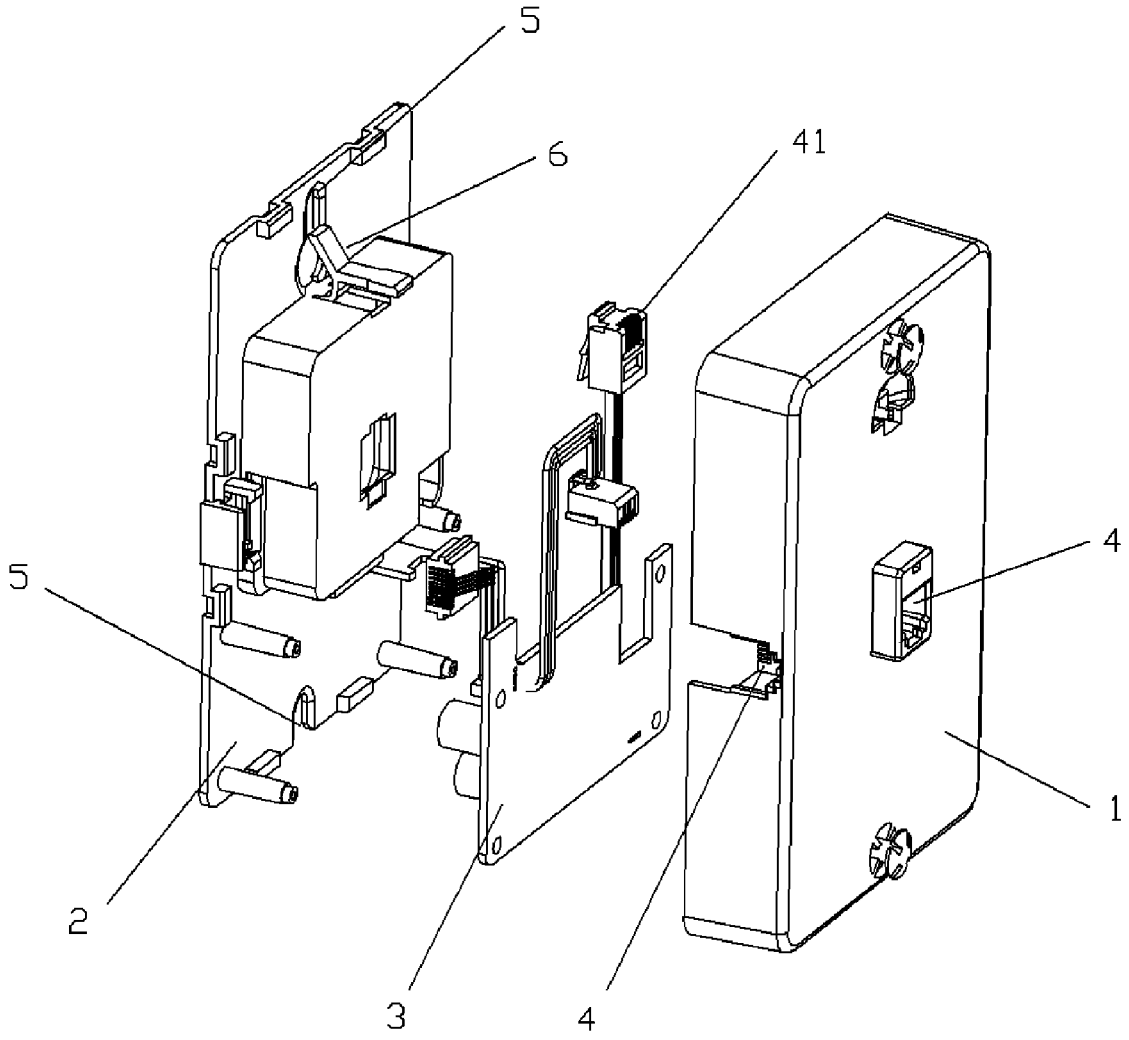
FIG. 3 is an exploded view showing the construction of the present invention.
Figure 4:
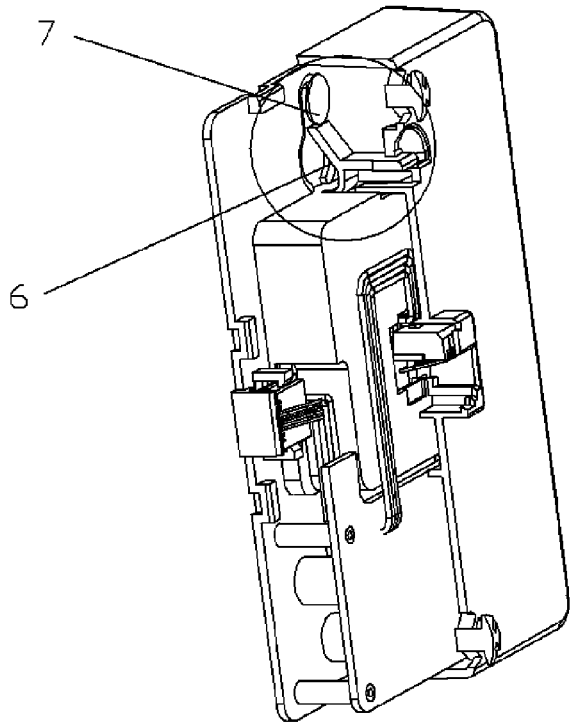
FIG. 4 is a schematic view showing a local part taken from FIG. 2.
Figure 5:
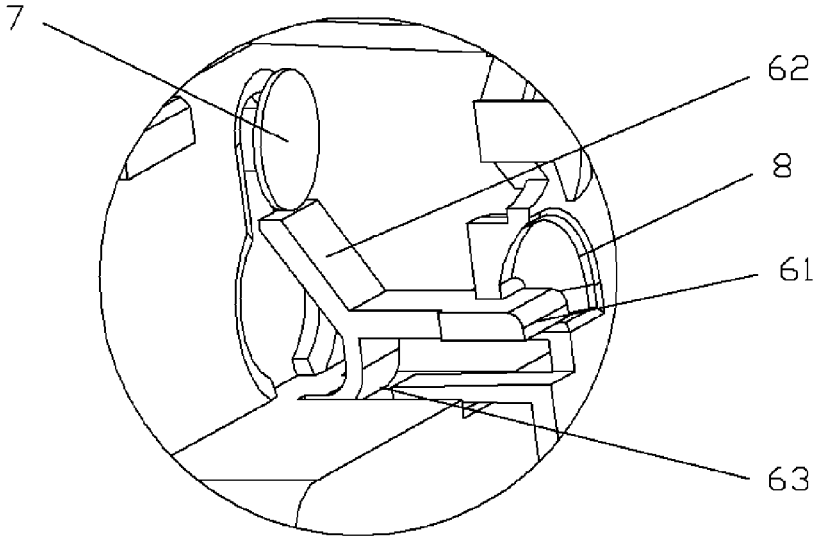
FIG. 5 is a magnified view of FIG. 4.

Now referring to FIGS. 3, 4, and 5, the communication adapter includes a casing comprised of the upper lid 1 and a lower lid 2, a circuit board 3 contained in the casing, two plugs 41 and two sockets 4 connecting to the circuit board 3, and two locking holes 5 to secure the upper lid 1 to the lower lid 2 with two locking pins 7. The locking tongue 6 is disposed to the lower lid 2 to further firmly secure the locking pin 7 to the locking hole 5; and a hole 8 allowing to pull the locking pin is disposed on the upper lid 1 to facilitate disassemble the adapter.

Two sockets 4 provided on the surface of the casing are respectively connecting to a telephone set and a computer. The locking tongue 6 is comprised of a pull part 61, a locking part 62 to secure the locking pin 7, and a curved part 63 connecting to the lower lid 2. Once the locking pin 7 is driven into the locking hole 5, the movement of the locking pin 7 is restricted by the locking part 62 of the locking tongue 6 to achieve better fastness results. To disassemble, the pull part 61 is pulled to drive the locking part 61 for creating a certain amount of elastic displacement, thus to easily remove the locking pin 7 out of the locking hole 5. Both of the locking tongue 6 and the lower lid 2 are made in an integrated part of a material giving certain elasticity such as plastic or hardware. Two locking holes are disposed on the lower lid 2 to secure the adapter to a wall-mounting panel.

The prevent invention provides an improved structure of a communication adapter, and the application for a utility patent is duly filed accordingly. However, it is to be noted that the preferred embodiments disclosed in the specification and the accompanying drawings are not limiting the present invention; and that any construction, installation, or characteristics that is same or similar to that of the present invention should fall within the scope of the purposes and claims of the present invention.

I claim:

1. A telecommunication cable adapter includes a casing comprised of an upper lid and a lower lid, a circuit board contained in the casing, a plug and a socket connecting to the circuit board, a locking hole disposed on the lower lid to be inserted with a locking pin, one or a plurality of locking tongue being provided to the lower lid, and a hole to pull the locking tongue being provided on the upper lid.

2. The telecommunication cable adapter of claim 1, wherein two or multiple sockets are provided on the surface of the casing.

3. The telecommunication cable adapter of claim 1, wherein the locking tongue is comprised of a pull part, a locking part to secure the locking pin, and a curved part connecting to the lower lid.

4. The telecommunication cable adapter of claim 1, wherein both of the locking tongue and the lower lid are made in an integrated part.

5. The telecommunication cable adapter of claim 1, wherein two or multiple locking holes are disposed on the upper lid.

* * * * *